US007437998B2

(12) United States Patent
Burger et al.

(10) Patent No.: US 7,437,998 B2
(45) Date of Patent: Oct. 21, 2008

(54) WATER-RIDE FACILITY

(75) Inventors: Guenter Burger, Waldkirch (DE); Frank Sornik, Waldkirch (DE); Thorsten Koebele, Riegel (DE); Jens Gessner, Voerstetten (DE)

(73) Assignee: Mack Rides GmbH & Co. KG, Waldkirch (DE)

( * ) Notice: Subject to any disclaimer, the term of this patent is extended or adjusted under 35 U.S.C. 154(b) by 346 days.

(21) Appl. No.: 11/305,198

(22) Filed: Dec. 19, 2005

(65) Prior Publication Data

US 2006/0130698 A1 Jun. 22, 2006

(30) Foreign Application Priority Data

Dec. 20, 2004 (DE) ..... 10 2004 062 315

(51) Int. Cl.
*A63G 7/00* (2006.01)
*A63G 1/00* (2006.01)

(52) U.S. Cl. ..... 104/73; 104/23.1

(58) Field of Classification Search ..... 104/23, 104/23.1, 23.2, 73, 72, 70, 59, 139, 154, 104/161, 60, 243; 472/117, 129, 135, 128, 472/127, 134

See application file for complete search history.

(56) References Cited

U.S. PATENT DOCUMENTS 1,357,995 A * 11/1920 Kitterman ..... 472/13
1,440,661 A * 1/1923 Dickinson ..... 104/66
1,563,855 A * 12/1925 Held ..... 280/18
1,607,771 A * 11/1926 Miller ..... 104/63
2,064,035 A * 12/1936 Rynearson ..... 104/71
2,235,563 A * 3/1941 Ridgway ..... 104/73
3,003,430 A * 10/1961 Hamel ..... 104/72
3,113,528 A * 12/1963 Morgan et al. ..... 104/73
3,404,635 A * 10/1968 Bacon et al. ..... 104/70
3,930,450 A * 1/1976 Symons ..... 104/73
4,063,517 A * 12/1977 Nardozzi, Jr. ..... 104/35
4,149,469 A * 4/1979 Bigler ..... 104/73
4,337,704 A * 7/1982 Becker et al. ..... 104/70
4,392,434 A * 7/1983 Durwald et al. ..... 104/70
5,006,072 A * 4/1991 Letovsky et al. ..... 434/61
5,011,134 A * 4/1991 Langford ..... 472/117
5,016,540 A * 5/1991 Barber ..... 104/53

(Continued)

FOREIGN PATENT DOCUMENTS

DE 298 23 592 U1 11/1999

*Primary Examiner*—J. Allen Shriver
*Assistant Examiner*—Jason C Smith
(74) *Attorney, Agent, or Firm*—Nath Law Group; Jerald L. Meyer; Jon A. Kidney

(57) ABSTRACT

A water ride containing at least one watercraft is described, having at least a floating body and a chassis which is connected thereto in an articulated manner and which serves as a guide unit, and a guide for the chassis which runs in the water, and a drive for the watercraft, wherein the floating body is connected to the chassis via a connection unit which comprises flexible elements and which allows relative movements of the floating body with respect to the chassis, wherein arranged on the floating body and on the chassis are associated coupling elements which serve for rigidly connecting the floating body and the chassis in at least one relative position, and in that the coupling elements are designed in such a way that the floating body is fixed on the chassis after being lowered.

16 Claims, 3 Drawing Sheets

U.S. PATENT DOCUMENTS 5,215,015 A * 6/1993 Iida et al. ..... 104/23.1
5,473,990 A * 12/1995 Anderson et al. ..... 104/85
5,542,356 A * 8/1996 Richert et al. ..... 104/289
5,564,984 A * 10/1996 Mirabella et al. ..... 472/43
5,566,620 A * 10/1996 Siewert ..... 104/124
5,613,443 A * 3/1997 Ariga et al. ..... 104/70
5,623,878 A * 4/1997 Baxter et al. ..... 104/85
5,669,308 A * 9/1997 Gerhardt ..... 104/155
5,732,635 A * 3/1998 McKoy ..... 104/73
5,775,226 A * 7/1998 Futami et al. ..... 104/71
5,860,364 A * 1/1999 McKoy ..... 104/59
6,095,926 A * 8/2000 Hettema et al. ..... 472/59
6,170,403 B1 * 1/2001 Behringer ..... 104/59
6,237,499 B1 * 5/2001 McKoy ..... 104/59
6,354,223 B2 * 3/2002 McKoy ..... 104/72
6,533,670 B1 * 3/2003 Drobnis ..... 472/60
6,553,915 B2 * 4/2003 Tseng ..... 104/23.1
6,592,374 B1 * 7/2003 Kim ..... 434/58
6,629,501 B2 * 10/2003 McKoy ..... 104/72
6,860,209 B2 * 3/2005 McKoy ..... 104/72
6,964,614 B1 * 11/2005 Tsai ..... 472/58
6,971,317 B2 * 12/2005 McKoy ..... 104/72
7,094,157 B2 * 8/2006 Fromyer et al. ..... 472/59
2006/0130698 A1 * 6/2006 Burger et al. ..... 104/73
2006/0219124 A1 * 10/2006 Jordan ..... 104/23.1
2007/0089635 A1 * 4/2007 Blanco Montejo ..... 104/139
2007/0207869 A1 * 9/2007 Hunter ..... 472/117

* cited by examiner

WATER-RIDE FACILITY

BACKGROUND

The invention relates to a water-ride facility.

Rides of this kind, which are very popular in leisure parks, provide water lanes, including ones of a type resembling roller coasters, with a pre-established path for a watercraft, e.g., a boat or similar floating body.

In order to give the passenger as a realistic as possible a sense of boat travel the watercraft should float freely in the areas containing water.

In order to achieve this end, the watercraft are usually guided in channels which are made, at least in part, of concrete or plastic and which are powered by drives that are most often provided under the surface of the water. This drive may be a wire cable guided in different directions over guide rollers, such that the floating body of the watercraft, which is attached to this wire cable, is pulled through the water. Furthermore, the vessel may be driven by local current pumps or by means of the channel gradient.

Also known are white-water lanes, which are designed like roller coasters. Here the watercraft pass through a schuss section and reach an area of water located at a lower elevation. Since the vessel is exposed to high forces and high load changes, safety is of special importance in the schuss section. Consequently the floating body of the watercraft is firmly attached to an undercarriage that is guided by rails, at least in the area of the schuss section.

In order to realize an operation that is as naturalistic as possible, the undercarriage of the watercraft can leave the guide system after the schuss section has been traversed, with the result that the watercraft floats more or less freely inside of the channel.

To be sure, controlling the vessel inside this area, particularly given a varying load on the boat, is problematic, or at least extraordinarily costly. It is also impossible to prevent the watercraft from colliding with the channel walls during operation, and this fact disrupts the passenger's sense that the vessel is floating freely.

Threading the undercarriage into the guide mechanism after leaving behind the area in which the watercraft floats freely is particularly difficult. No less problematic is unthreading the undercarriage after passing through a schuss section, since for reasons of safety this can only occur if the floating body has stabilized after entering the water. For example, forces that arise after the craft enters the water can be used to only a limited degree in influencing the travel effect.

The continuous guidance of an undercarriage firmly attached to the floating body is generally preferred across the entire body of water, and for the reasons indicated above, though the price paid for this is that the floating motion of the vessel body is comparatively unrealistic.

It is true that DE 298 23 591 U1 describes a watercraft in which a floating body is connected in a flexible manner to an undercarriage acting as a guide unit. However, this flexible connection does not make it possible for the floating body to float naturalistically.

The present invention is based on the problem of creating a water-ride in which the watercraft is safely conducted in all areas, including schuss sections where there are large differences in elevation, and the floating body nonetheless executes largely naturalistic movements in the remaining areas of water, even given a varying load and a varying water level, and the unnaturalistic guidance of the vessel through the water channel is eliminated.

SUMMARY

Therefore, the above problem is solved in that the floating body is connected to the undercarriage, which serves as a guide unit, by a connecting unit exhibiting flexible or articulated elements and permitting the floating body to execute limited transverse or lifting motions relative to the undercarriage.

In this solution the floating body can execute rocking and rolling movements typical of travel by boat, and it can adapt to different water levels, while being safely conducted over the entire course of the trip.

If the watercraft is to pass through a schuss section, the floating body, in accordance with a basic idea of the invention, is firmly connected to the carriage for a given period of time.

In one embodiment, a water ride containing at least one watercraft, is provided, comprising: a floating body and a chassis which is connected thereto in an articulated manner and which serves as a guide unit; a guide for the chassis which runs in the water; and a drive for the watercraft, wherein the floating body is connected to the chassis via a connection unit which comprises flexible elements and which allows relative movements of the floating body with respect to the chassis, wherein arranged on the floating body and on the chassis are associated coupling elements which serve for rigidly connecting the floating body and the chassis in at least one relative position, and in that the coupling elements are designed in such a way that the floating body is fixed on the chassis after being lowered. Consequently, coupling elements that are assigned to one another and that lock together are provided on the floating body and on the undercarriage; these coupling elements serve to create the firm connection between the floating body and the undercarriage in at least one relative position. In this way the watercraft is safely guided during schuss sections that resemble a roller-coaster, but has the realistic characteristics of a freely floating boat when the water section is reached.

Since the watercraft can be designed with an undercarriage typical of roller-coasters, it is able to pass through typical roller-coaster sections, such as schusses, loops, Immelmann curves, horseshoe curves, lifts, helical curves, and the like, despite having the typical characteristics of a freely floating boat. The important factor here is an absolutely secure lock between the coupling elements, e.g., by means of redundant locking and/or dead-center locking. Also suitable are coupling elements designed as king pins and pivot bearings, such as those used in trucks to connect a semi-trailer truck and a semi-trailer.

Particularly useful are coupling elements which utilize the force of gravity and are so designed that, given an appropriate track layout, the floating body, upon dropping onto the undercarriage, will automatically connect with the undercarriage and preferably will lock with it. The locking mechanism here will permit controlled unlocking.

A large range of possibilities presents itself for designing the connecting unit that is employed to connect the floating body to the undercarriage.

In accordance with another embodiment, the flexible connecting unit may consist joint rods, telescope bars, linear guides, or also a rotating assembly, arranged to form transverse and longitudinal guides.

A flexible connection may also be considered, according to which the flexible elements of the connecting unit can be cords, chains, belts, or air pillows.

To actuate these connecting elements, hydraulic or pneumatic cylinders are suitable, as are cable feeds in the case of cables or the like, e.g., in the form of motor-driven cable drums, which preferably will be controllable.

Likewise, an entire spectrum of possibilities is available for embodying the floating body. Suitable for this are boats with a single or multiple fuselage, e.g., catamarans or rafts. The boats can take the form of sailboats, motorboats, or rowboats.

Known drives are suitable for the water-ride facility according to the invention, e.g., cable drives or conveyor chain drives that are connected to the vehicle; friction gear drives or gearwheel drives provided on the guidance system; and fluid drives, particularly fluid pump drives, where controllable outlet nozzles preferably will be provided in the water, i.e., below the surface of the water, close to the guidance system. Finally, it is possible to use induction drives, particularly linear induction motor drives.

When the layout includes schuss sectors, the watercraft can be driven by gravity.

Many maneuvers and effects can be realized when these technical possibilities are made use of.

Depending on the requirements, the guidance system may consists of a rail, as in monorail tracks, or of rail forms that are typical of roller-coasters, where running and support wheels—provided on the undercarriage and resting in rolling fashion on the tracks, even during the execution of complicated curves and loops—provide for an always secure connection.

In the water-ride facility according to the invention, controllable braking devices which can be positioned either on the undercarriage or on the guidance system will provide for the necessary reduction in speed and for bringing the craft to a defined stop.

The subject matter of the invention is next described in detail on the basis of a preferred exemplary embodiment, which is schematically depicted in the drawings. Shown in the drawings are:

Front view of the watercraft according to the invention, on a guide rail typical of roller coasters, showing the floating body while it is floating

FIG. 2

Figure 1:
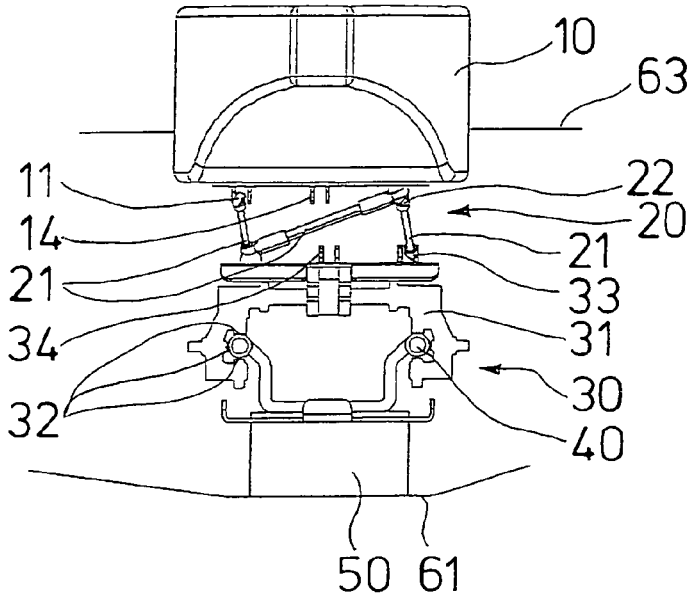
FIG. 1

Reduced-scale lateral view of the watercraft of FIG. 1, inside a channel

FIG. 3

Front view of the watercraft of FIG. 1, outside of the water

FIG. 4

Figure 3:
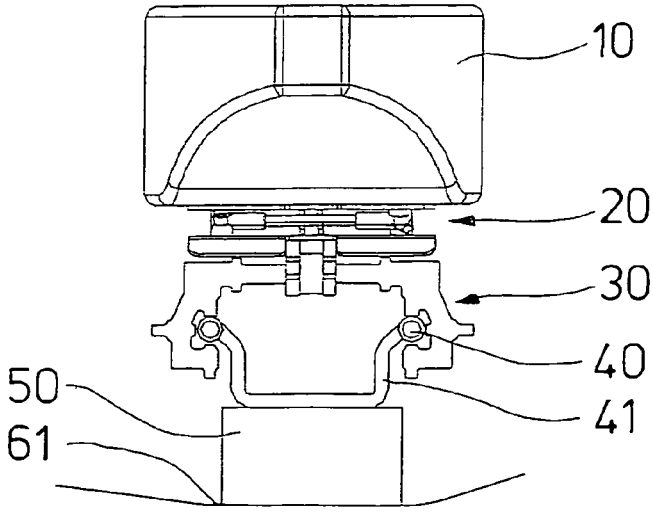

Reduced-scale lateral view of the vehicle of FIG. 3

FIG. 5

Top view of the watercraft

FIG. 6

Perspective view of a section through the water-ride facility according to the invention.

DETAILED DESCRIPTION

The watercraft according to the invention consists of a floating body 10 designed in the form of a boat. The floating body 10 is connected to the undercarriage 30 by means of an articulated connecting unit 20. With its running and support wheels, which have a pivoted mounting in the chassis 31 and are only suggested in the drawing, the undercarriage 30 rests on parallel tubular rails 40, which are connected to the base pedestal 50 of the water-ride facility by means of rail supports 41.

In the depicted exemplary embodiment the connecting unit 20 consists of joint rods 21, which are designed and positioned in the manner of transverse and longitudinal guides. The ball-shaped heads 22 of these joint rods 21 are pivot-mounted on all sides in corresponding bearings 11 and 33, which belong to the floating body 10 or the undercarriage 30.

Figure 4:
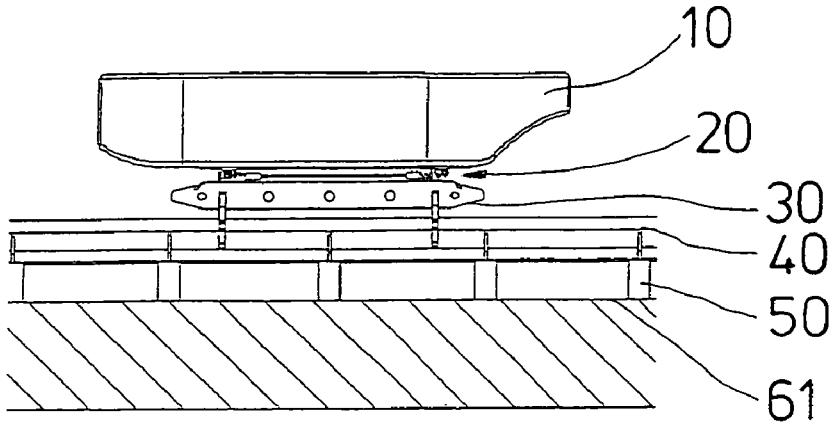

Provided on the lower side of the floating body 10 and on the upper side of the undercarriage 30 are matching coupling elements 14 and 34 which connect with each other and lock together. The joints rods 21 and the bearings 11 and 33 for the ball-shaped heads are so dimensioned and positioned that the coupling elements 14 and 34 engage with each other when the floating body 10 drops. This is depicted in FIGS. 3 and 4. In this position the floating body 10 can be firmly connected to the undercarriage, so that the vessel is able to pass through all the conceivable curves and slopes of a roller coaster without difficulty.

Figure 2:
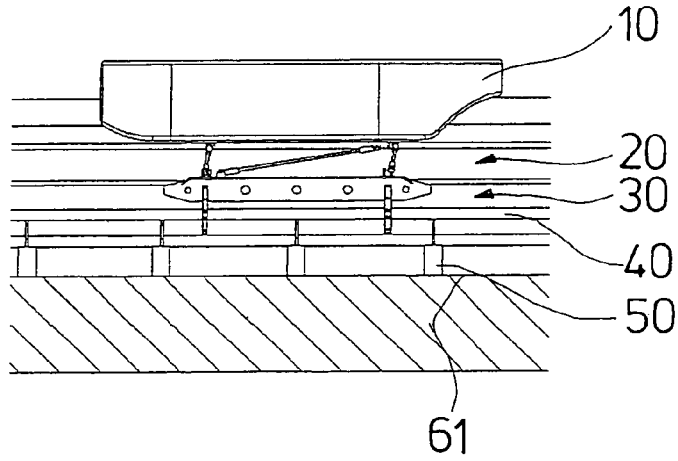

In the positions shown in FIGS. 1 and 2, on the other hand, the articulated connecting unit 20 permits the floating body 10 to execute relative movements vis-a-vis the undercarriage 20, so that, like a boat that is floating freely, the floating body can execute the rocking and rolling movements typical of a floating body, even given varying water levels 63 and varying loads.

Figure 5:
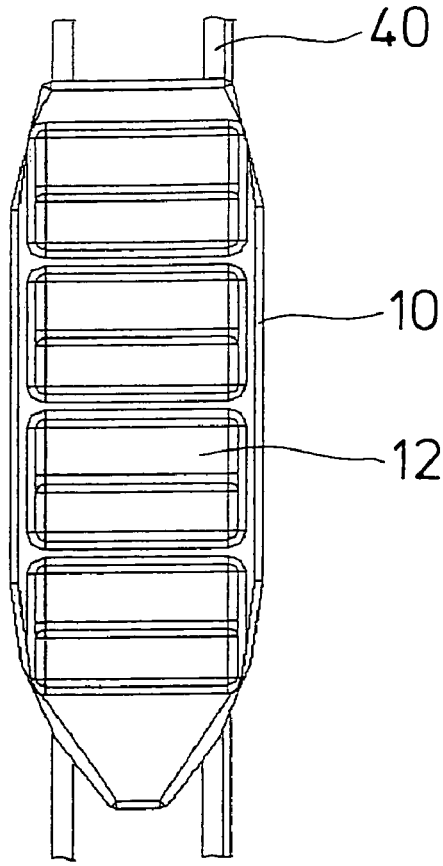

Consequently, the floating body 10, whose passenger seats 12 are indicated in FIG. 5, can be conducted through the water in a naturalistic manner by means of the undercarriage 30 and the rails 40 that are located beneath the surface of the water 63.

Figure 6:
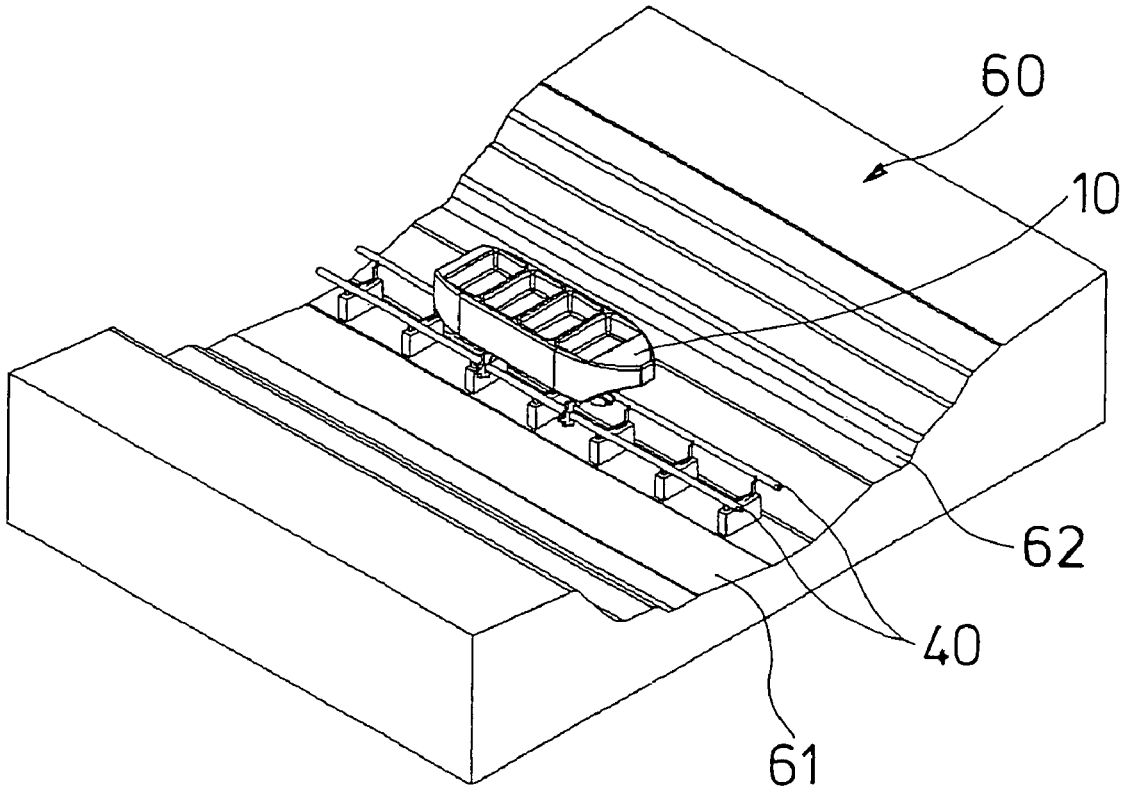

As depicted in FIG. 6, the body of water can be a water channel 60, which is bordered by the channel floor 61 and the channel walls 62. The body of water can also take the form of a large-scale lake or a winding river.

LIST OF REFERENCE NUMERALS

10 floating body
11 ball-headed bearing
12 passenger seats
14 coupling element
20 connecting unit
21 joint rods
22 ball-shaped head
30 undercarriage
31 chassis
32 running and support wheels
34 coupling element
40 guide rails
41 rail supports
50 base pedestal
60 channel
61 channel floor
62 channel wall
63 surface of water

The invention claimed is:

1. A water ride containing at least one watercraft, comprising:

a floating body and a chassis which is connected thereto in an articulated manner and which serves as a guide unit;

a guide for the chassis which runs in the water; and a drive for the watercraft, wherein the floating body is connected to the chassis via a connection unit which comprises flexible elements and which allows relative movements of the floating body with respect to the chassis, wherein arranged on the floating body and on the chassis are associated coupling elements which serve for rigidly connecting the floating body and the chassis in at least one relative position, and in that the coupling elements are designed in such a way that the floating body is fixed on the chassis after being lowered.

2. The water ride according to claim 1, wherein the coupling elements can be locked, and wherein the locked coupling elements can be released in a controlled manner.

3. The water ride according to claim 1, wherein the connection unit is at least one of articulated rods which form transverse and longitudinal control arms, and of telescopic rods, linear guides, and rotation assemblies.

4. The water ride according to claim 1, wherein the flexible elements are at least one of cables, chains, belts and air cushions.

5. The water ride according to claim 3, wherein the connection unit is connected to at least one of a hydraulic, pneumatic cylinders, and cable feeds, which can be controlled.

6. The water ride according to claim 1, wherein the coupling elements have a redundant locking mechanism and/or a dead-centre locking mechanism or are designed as a king pin and a king pin bearing.

7. The water ride according to claim 1, wherein the floating body is a single-hulled or multi-hulled boat or a raft.

8. The water ride according to claim 7, wherein the boat is a sailing boat, a motorboat or a rowing boat.

9. The water ride according to claim 1, wherein drives are at least one of a cable drive and conveyor belt drive, which is mechanically connected to the craft.

10. The water ride according to claim 1, wherein the drive is at least one of a friction wheel drive and a toothed wheel drive.

11. The water ride according to claim 1, wherein the drive is a flow drive, comprising a pumped flow drive, with controllable outlet nozzles arranged in the water close to the guide.

12. The water ride according to claim 1, wherein the drive is an inductive motor drive.

13. The water ride according to claim 1, wherein the guide has downhill sections in which the watercraft is driven by gravity.

14. The water ride according claim 1, wherein the guide comprises at least one or more rails.

15. The water ride according to claim 1, further comprising running wheels or support wheels provided on the chassis, the running or support wheels resting on the guide rails in a rolling manner.

16. The water ride according to claim 1, wherein brake devices are arranged on the chassis and/or on the guide.

* * * * *